US006106200A

United States Patent [19]

Mocivnik et al.

[11] Patent Number: 6,106,200

[45] Date of Patent: Aug. 22, 2000

[54] PROCESS AND DEVICE FOR SIMULTANEOUSLY DRILLING AND LINING A HOLE

[75] Inventors: Josef Mocivnik, Fohnsdorf; Karl Bohm, Ansfelden, both of Austria

[73] Assignees: Techmo Entwicklungs-und Vertriebs GmbH, Fohndorf; "ALWAG" Tunnelausbau Gesellschaft m.b.H., Pasching, both of Austria

[21] Appl. No.: 09/310,157

[22] Filed: May 12, 1999

Related U.S. Application Data

[63] Continuation of application No. PCT/AT97/00247, Nov. 12, 1997.

[30] Foreign Application Priority Data

Nov. 12, 1996 [AT] Austria ..... 1978/96
Jun. 18, 1997 [AT] Austria ..... 1065/97

[51] Int. Cl.[7] ..... E21D 20/00; E21B 10/64

[52] U.S. Cl. ..... 405/259.5; 175/23; 175/257; 405/244; 405/259.1

[58] Field of Search ..... 405/244, 259.1, 405/259.3, 262, 133, 240, 241, 242, 233; 175/23, 257

[56] References Cited

U.S. PATENT DOCUMENTS

| | | | |
|---|---|---|---|
| 576,953 | 2/1897 | Davis | 175/23 |
| 2,682,152 | 6/1954 | Bierer | 405/259.3 |
| 3,185,226 | 5/1965 | Robbins | 405/133 X |
| 3,190,378 | 6/1965 | Davey, Sr. | 175/257 |
| 3,682,260 | 8/1972 | Klemm | 175/92 |
| 3,732,143 | 5/1973 | Joosse | 175/6 |
| 3,901,331 | 8/1975 | Djurovic | 175/171 |
| 3,933,209 | 1/1976 | Sweeney | 175/257 X |
| 4,519,735 | 5/1985 | Machtle | 405/259.3 X |
| 4,761,098 | 8/1988 | Lipsker | 405/241 X |
| 5,152,649 | 10/1992 | Popp | 405/259.4 X |
| 5,516,237 | 5/1996 | Hebant | 405/233 |
| 5,845,722 | 12/1998 | Makohl et al. | 175/257 X |

FOREIGN PATENT DOCUMENTS

| | | |
|---|---|---|
| 390303 | 4/1990 | Austria . |
| 2818936 | 11/1978 | Germany . |
| 4432710 | 11/1996 | Germany . |
| WO94/12760 | 6/1994 | WIPO . |
| WO96/04456 | 2/1996 | WIPO . |

*Primary Examiner*—Dennis L. Taylor
*Attorney, Agent, or Firm*—Jacobson, Price, Holman & Stern, PLLC

[57] ABSTRACT

In a process for drilling, in particular rotary percussion or percussion drilling, and lining holes in the ground or rocks, a hole is percussion and/or rotation drilled by a cutter mounted on boring rods and a lining is formed by a jacket tube. During drilling, at least one jacket tube coupled to the cutter is drawn in the axial direction by the cutter into the bore hole and once drilling is finished, the cutter is at least partially removed from the jacket tube together with the boring rods. In a device for drilling, in particular percussion or rotary percussion drilling, and lining holes in the ground or rocks, a cutter mounted on boring rods drills a bore hole by percussion and/or rotary drilling. The cutter is divided in the radial direction. At least one jacket tube which surrounds the boring rods is located at the end of the cutter away from the drilling surface, around the outer circumference of the cutter, and is form-fittingly joined to the cutter by at least one coupling element so as to be drawn in the longitudinal direction of the bore hole.

22 Claims, 6 Drawing Sheets

5a
5b
29'
6'
34
29
31
30
32
33

PROCESS AND DEVICE FOR SIMULTANEOUSLY DRILLING AND LINING A HOLE

This is a Continuation Application based on PCT/AT97/00247, filed Nov. 12, 1997.

BACKGROUND OF THE INVENTION

The present invention relates to a method for drilling, in particular impact drilling or rotary percussion drilling, and lining of and/or inserting of roof bolts into holes in soil or rock material, wherein a drill hole is formed by means of a drill bit mounted on a drill rod assembly by a percussive and/or rotary movement and a lining is formed by means of a jacket tube, wherein after completion of the drilling procedure the drill bit is removed from the jacket tube at least partially together with the drill rod assembly. Furthermore, the present invention relates to a device for drilling, in particular impact drilling or rotary percussion drilling, and lining of and/or inserting of roof bolts into holes in soil or rock material, wherein a drill bit mounted on a drill rod assembly makes a drill hole by a percussive and/or rotary movement.

Methods and devices of this type, for drilling and, in particular, impact drilling or rotary percussion drilling and subsequently lining holes in soil or rock material are known in various configurations. Thereby, a hole or a bore optionally extending over a great length is formed by aid of a drill bit mounted on a drill rod assembly, the drill hole being formed by a percussive and/or rotary movement. In rotary percussion drilling, the drill bit after each percussive stress exerted on the same, usually is rotated by a defined angle and acted upon anew by means of a percussion tool, wherein, by the alternate displacement of the drill bit in the direction of rotation and the intermittent percussion, the material is systematically disintegrated and broken out on the surface covered by the drill bit during the rotary movement. In order to prevent material from breaking into the drill hole optionally extending over a great length and/or provide for an essentially smooth and plane lining after completion of the bore, it was, for instance, proposed to use an accordingly sturdily designed jacket tube while exerting the percussive movement on the drill bit, for instance, via the jacket tube, the jacket tube, strictly speaking, thus constituting a part of the drilling or advance working device. It is immediately apparent that such a jacket tube has to be accordingly sturdy and thick-walled in order to introduce the high impact forces required, from which follows that an accordingly increased cross section must be drilled in order to take into account the wall thickness of the jacket tube. Such a working cross section augmented by the wall thickness of the jacket tube involves an accordingly extended period of time for producing a bore, in particular with hard rock, at the same time calling for an accordingly larger and sturdily designed drill bit.

Instead of using a jacket tube for introducing the impact forces, methods have, moreover, become known, in which a plurality of time-consuming operating steps serve to remove the drill bit from the drill hole after completion of the drill hole and to insert a lining or jacket tube into the drill hole after this. It is immediately apparent that such a mode of procedure is applicable only in those cases in which the breaking in of material into the completed drill hole can be excluded for sure, wherein, moreover, an accordingly increased cross section must, of course, be drilled in order to render feasible the subsequent insertion of a lining or jacket tube. In order to be able to insert such a lining or jacket tube having a great length, that tube must again have a relatively large wall thickness so as to render feasible its safe introduction. A drill bit matching with the dimensions of the jacket tube and thus having a relatively large diameter must, therefore, be used also in that case.

After having inserted the lining or jacket tube, a roof bolt may, for instance, be inserted into the jacket tube and, additionally or alternatively, also an accordingly rapidly setting material for solidifying the surrounding material. Alternatively, such a lining may serve to accommodate ducts or the like or, when providing perforations, be used for carrying off liquids and hence for drainage.

SUMMARY OF THE INVENTION

Departing from a method for drilling, in particular impact drilling or rotary percussion drilling, and lining holes in soil or rock material, the present invention, therefore, aims at further developing with a view to enabling the insertion of at least one jacket tube substantially simultaneously with the formation of the drill hole in a quick and simple manner. Furthermore, it is aimed at employing a jacket tube or jacket tubes having reduced dimensions and, in particular, reduced wall thicknesses as compared to known configurations in order to be able to minimize the additional expenditures required for the jacket tube(s) during drilling.

To solve this object, the method according to the invention essentially is characterized in that with the advance movement during drilling at least one thin-walled jacket tube coupled at the end facing away from the work face with the drill bit being divided in radial direction is introduced into the drill hole in the axial direction by means of the drill bit only by tensile action and that after the removal of the drill rod assembly and of the drill bit a roof bolt is introduced into the jacket tube(s) and/or a filling is realized with a solidifying material. By introducing, according to the invention, a jacket tube coupled with the drill bit into the drill hole by tensile action merely in the axial direction with the advance movement during drilling, it is ensured that lining of the drill hole may be effected already immediately upon making of the same such that the breaking in of possibly loose rocks and hence the obstruction of the drill hole can be safely avoided. By introducing into the drill hole the at least one jacket tube directly by means of the drill bit by mere axial action, it is, furthermore, feasible to do with a very thin-walled jacket tube, since the jacket tube does not have to absorb and transmit any forces as was the case, for instance, according to prior art wherein impact forces were exerted onto the drill bit via an accordingly sturdy jacket tube, and merely must exhibit a sufficient strength in order to safely avoid bending or a cross sectional reduction caused by possibly loose rock. In order to ensure the simple removal of the drill bit together with the drill rod assembly without changing the position of the jacket tube within the drill hole after completion of the bore, the invention, moreover, proposes to remove the drill bit from the jacket tube at least partially together with the drill rod assembly. To this end, the drill bit may, for instance, be divided into a substantially central part and an outer part surrounding the central part in a substantially annular manner such that, upon detachment of the central part, this main component of the drill bit can be removed from the drill hole together with the drill rod assembly through the interior of the at least one jacket tube. According to the invention it is further proposed that, after the removal of the drill rod assembly and of the central part of the drill bit, a roof bolt is introduced into the jacket tube(s) and/or a filling is realized with a solidifying material.

In order to ensure, during a rotary movement of the drill bit, that the jacket tube(s) coupled with the drill bit during drilling is nevertheless introduced merely in the axial direction of the drill hole by tensile action in the sense of the advance movement, it is additionally proposed in a preferred manner that the drill bit is arranged so as to be rotatable relative to the jacket tube(s).

For the simple extraction of the material worked by means of the drill bit, it is, moreover, proposed in a preferred manner that worked material is introduced into the interior of the jacket tube(s) via at least one aperture provided in the region following upon the drill bit and is extracted from the drill hole in the free space provided between the jacket tube(s) and the drill rod assembly. By extracting the worked material from the drill hole in the free space provided between the jacket tube or tubes and the drill rod assembly, the necessary drill hole cross section may be further reduced such that the external dimensions of the drill hole may be adapted substantially to the external diameter of the outer jacket tube, favourably exceeding the same merely by a slight measure.

In order to solve the objects set out above, a device according to the invention for drilling, in particular impact drilling or rotary percussion drilling, and lining holes in soil or rock material, wherein a drill bit mounted on drill rod assembly makes a drill hole by a percussive and/or rotary movement, is essentially characterized in that the drill bit is designed to be divided in its radial direction and that, on the external periphery of the drill bit on the end facing away from the work face, at least one thin-walled jacket tube surrounding the drill rod assembly is positively connected with the drill bit via at least one coupling element only for tensile entrainment in the longitudinal direction of the drill hole. By the drill bit being designed to be divided in the radial direction, it can be ensured in a simple manner upon completion of the drill hole that, for instance, the central main part of the drill bit may be removed from the drill hole together with the drill rod assembly through the jacket tube while the at least one jacket tube is introduced into the drill hole directly in the production of the drill hole by tensile entrainment effected in the longitudinal direction of the drill hole and remains within the drill hole after completion of the drill hole. In order to ensure that the jacket tube(s) mounted on the external periphery of the drill bit are acted upon merely in the axial direction of the drill hole even at a rotary movement of the drill bit, it is, moreover, provided in a preferred manner that the drill bit is rotatably connected with the jacket tube(s) via the coupling element.

With a view to providing particularly simple coupling between the drill bit and the jacket tube entrained in the axial direction by the drill bit at an advance movement, it is, moreover, proposed in a preferred manner that the coupling elements are formed by offset peripheral regions of the drill bit and of the jacket tube with matching complementary profiles, optionally by interposing a profiled annular intermediate member. Due to such offset peripheral regions, which, for instance, may be designed in the manner of steplike elevations and complementary depressions, the safe entrainment of the jacket tube during the advance movement of the drill bit will be ensured even with comparatively thin wall thicknesses of the jacket tube.

With a view to providing simple coupling between the drill bit and the jacket tube(s) to be entrained in the advance movement of the drill bit, it is alternatively proposed that the coupling elements are formed by a plurality of balls arranged in recesses provided on the drill bit and having substantially semi-circular cross sections and complementary recesses provided on a connection piece of the jacket tube(s) following upon the drill bit, as in correspondence with a further preferred embodiment of the device according to the invention. By using balls that are arranged in corresponding recesses both on the drill bit and on the connection piece of the jacket tube(s), an accordingly simple connection and coupling between the drill bit and the jacket tube(s) is feasible in the manner of a ball bearing, thus allowing for an accordingly easy rotatability of the at least one jacket tube relative to the drill bit at a rotary and/or rotary percussive movement of the drill bit during the production of a drill hole. According to a particularly preferred embodiment, it is provided in this respect that the connection piece of the at least one jacket tube and/or the connection zone of the drill bit are made of metal, synthetic material or a coated material, wherein matching of the individual materials both of the coupling elements and of the recessed connection piece of the jacket tube(s) and the end piece of the drill bit, respectively, is feasible when using balls of, for instance, metal or synthetic material. An accordingly easy displacement of the balls into the recesses provided to receive the coupling elements formed by the balls may, of course, be obtained by introducing a lubricant, for instance, oil.

In order to prevent forces that start to act on the drill bit at an advance movement, from being introduced into the jacket tube, which optionally has a very small cross section or slight wall thickness, and thus possibly causing deformation of the same, it is, moreover, proposed that the coupling elements between the drill bit and the jacket tube(s) at least partially are made of a damping material or are coated with a damping material, as in correspondence with a further preferred embodiment of the device according to the invention.

With a view to enabling the simple removal of worked material in the free space provided between the inner jacket tube and the drill rod assembly, whereby an accordingly small drill hole cross section substantially matching with the external dimensions of the outer jacket tube may be safeguarded, it is, moreover, provided in a preferred manner that the jacket tube(s) in its (their) end region(s) facing the drill bit comprises) at least one passage opening, in particular several bores or passage slits uniformly distributed over the circumference of the jacket tube.

As already indicated above, jacket tubes not only may be used for the subsequent insertion of a roof bolt and hence, in general, providing anchorage of objects, but it may, for instance, also be provided to effect drainage via the produced drill hole and the jacket tubes inserted therein. To this end, the invention preferably proposes that the jacket tube (s), over its (their) total length(s), is (are) designed to have perforations substantially uniformly distributed over the periphery.

In order to ensure the simple removal of the central part of the drill bit after completion of a drill hole, it is, moreover, proposed in a preferred manner that the drill bit at least is comprised of a central inner part and an outer part which are detachably coupled to each other for common advance movement, the central part of the drill bit having a slightly smaller external diameter relative to the internal diameter of the inner jacket tube. In order to allow for particularly simple and reliable coupling of the individual elements of such a multiple-part drill bit, it is, moreover, proposed in a preferred manner that, with a view to rotational entrainment, the central inner part of the drill bit has a cross section deviating from the circular form and is led out through an appropriate opening of the outer part of the drill bit.

As already mentioned several times, it is not necessary, due to the fact that the jacket tube is introduced directly through the drill bit by actuation in the axial direction during the advance or drilling movement, to provide a drill hole diameter strongly enlarged relative to the external dimensions of the outer jacket or lining tube, as was necessary according to prior art, in particular, with the subsequent introduction of a jacket tube. It will, therefore, do that the external diameter of the outer jacket tube substantially corresponds to the external dimensions of the drill bit in the radial direction.

Since the jacket tubes employed according to the invention substantially merely have to resist possibly breaking-in material and need not take up or transmit any forces such as, for instance, impact forces for rotary percussion drilling, accordingly thin-walled jacket tubes will suffice. In this context, the invention preferably proposes that the jacket tube(s) has (have) a wall thickness of from 1 to 3 mm and, in particular, about 2 mm such that it is immediately apparent that, by providing the jacket tubes, the overall surface to be worked or drilled need to be increased only slightly and also an accordingly reduced amount of material and hence weight will do for the jacket tube(s).

According to a particularly preferred embodiment, it is provided that the jacket tube(s) is (are) made of metal or synthetic material, thereby enabling accordingly simple adaptation to the surrounding conditions and, in particular, to the soil or rock material in which a drill hole is to be produced. While a jacket tube made of metal has an accordingly high mechanical strength, it may, however, be disadvantageous with such a configuration that loose or slack soil or rock layers may potentially affect the usually very thin-walled jacket tube by causing bending or cross-sectional contraction of the same, thereby possibly rendering difficult, or completely preventing, the subsequent removal of the drill bit and hence the subsequent introduction of, for instance, a roof bolt. In particular with such loose soil or rock material, the use of jacket tubes made of synthetic material and thus offering a certain flexibility has proved advantageous, since even in case of temporary cross sectional changes of the jacket tube(s), the jacket tubes will reassume their original cross sectional shapes during further advance of the drill bit taking the same with it, and the problem-free removal of the drill bit and optionally the subsequent insertion of a roof bolt will become readily feasible after completion of the drill hole. In particular, when using jacket tubes made of synthetic material, the use of coupling elements of the ball bearing type as pointed out above is particularly advantageous to enable free and largely undisturbed rotatability between the drill bit and the jacket tubes during the rotary or rotary percussion drilling movement of the drill bit, since the rotary entrainment of the jacket tube by the drill bit is to be regarded as disadvantageous when using jacket tubes made of synthetic material.

In order to minimize, in particular, in soil or rock layers comprising readily breaking-in material and thus causing the frictional forces acting on the jacket tubes to become especially large, said forces to the major extent possible, it is proposed according to the invention that two jacket tubes are arranged substantially concentric with each other and held at a distance from each other by means of spacer elements or stop elements provided in the interspace between the jacket tubes, preferably on one of the jacket tube surfaces facing each other. Due to the fact that two jacket tubes are arranged in a substantially concentric and spaced-apart manner, damage to the drill rod assembly may be safely avoided, on the one hand, even in case of overstressing of the outer jacket tube by breaking-in material and hence destruction of, or damage to, the same and, by the drill bit carrying with it only one of the two substantially concentrically arranged jacket tubes, it is feasible, on the other hand, to provide for a drill hole lining in which the drill hole lining external diameter is not constant over the total length. Such varying external dimensions of the drill hole lining help to minimize the frictional forces acting on the jacket tubes, in particular, in regions of reduced drill hole lining diameters.

In order to safeguard such a telescopability, or the separate entrainment of each of the two concentrically arranged jacket tubes, the invention is essentially characterized in that at least the externally arranged jacket tube is comprised of several parts and, in the region of at least one junction of neighbouring jacket tube portions, are detachably coupled with the inner tube via a fixation capable of being uncoupled by the relative rotation of neighbouring elements, in particular a bayonet catch. The multi-part design of the externally arranged jacket tube and the decouplable connection of neighbouring jacket tube portions enable one jacket tube portion to be entrained after having undone the fixation of two neighbouring jacket tube portions with the other jacket tube portion remaining stationary, thus obtaining a drill hole lining having varying diameters.

In order to ensure complete lining of the drill hole and concerted entraining of either the internally located or the externally located jacket tube portions, the device according to the invention preferably is devised such that the concentrically arranged jacket tubes in at least one end region each comprise stop elements extending into the annular space provided between the jacket tubes and that guiding and decoupling means for adjoining externally located jacket tube portions are arranged in the region of a connection element, in particular an inner tube sleeve element. By the concentrically arranged jacket tubes comprising stop elements extending into the annular space provided between the jacket tubes in at least one end region, the complete disengagement of the internally and externally located jacket tubes is safely avoided and the invention, furthermore, may ensure the concerted entrainment of certain inner and/or outer tube portions by providing an inner tube sleeve element comprising guiding and decoupling means.

In order to ensure the removal of the internally located section of the drill bit through the annular space defined by the jacket tubes, it is preferably provided that the concentrically arranged jacket tubes are connectable to the external region of the drill bit. In that case, in particular, at least the externally arranged jacket tube is fixed to the drill bit such that the safe entrainment of at least the outer jacket tube is guaranteed in the region of the drill bit.

BRIEF DESCRIPTION OF THE DRAWINGS

In the following, the invention will be explained in more detail by way of exemplary embodiments schematically illustrated in the annexed drawing. Therein.

DETAILED DESCRIPTION OF PREFERRED EMBODIMENTS OF THE INVENTION

Figure 2:
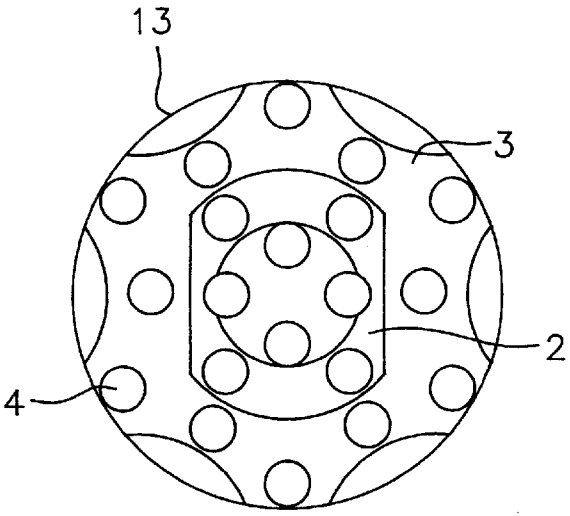
FIG. 2 is a view in the direction of the arrow II of FIG. 1, on the drill bit of the device according to the invention.
Figure 1:
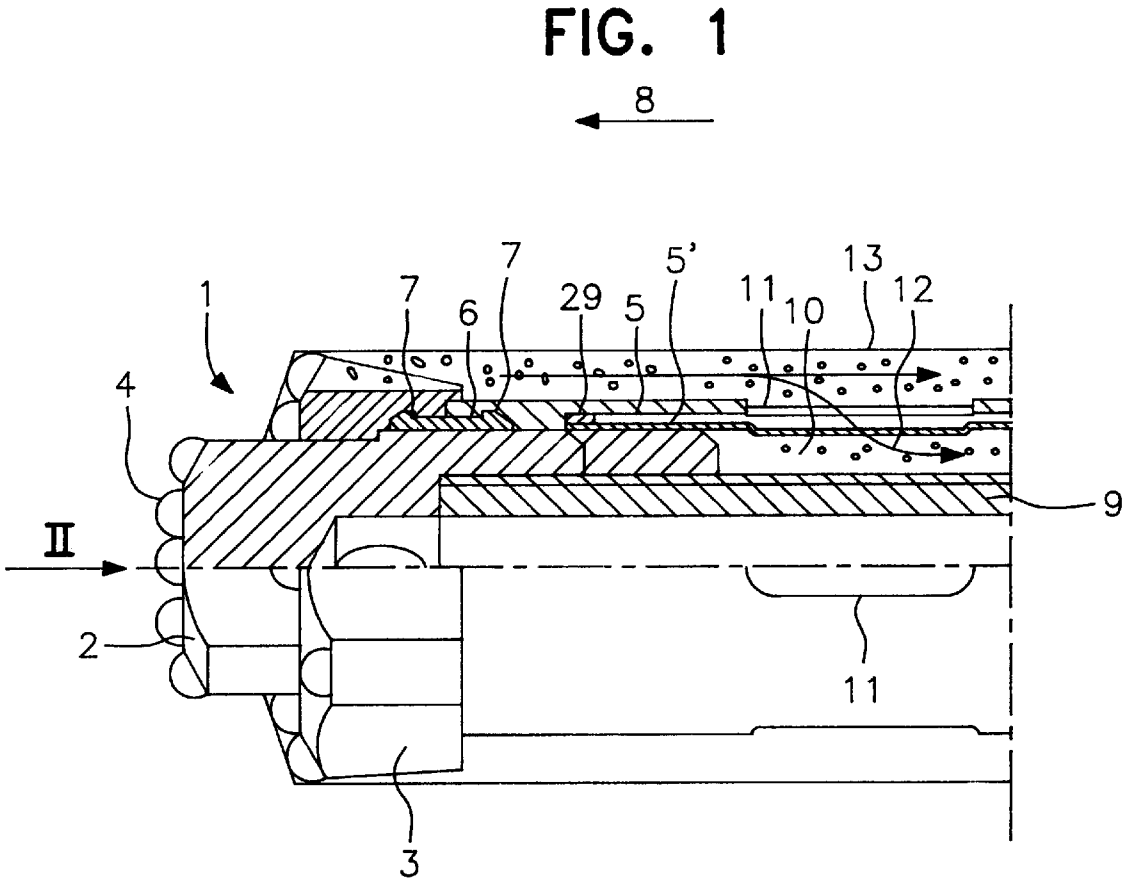
FIG. 1 is a partially sectioned partial view of a first embodiment of a device according to the invention for carrying out the method of the invention.

In FIGS. 1 and 2, a drill bit is generally denoted by 1, being comprised of a central portion, the socalled pilot bit 2, and an annular bit 3 surrounding the pilot bit 2. On the forward end faces of the pilot bit 2 and of the annular bit 3 are provided conventional working tools known per se such as, for instance, substantially semi-spherical hard material insets 4 for working the material.

On the end facing away from the working surfaces of the drill bit 1, a jacket tube having a relatively small wall thickness of for instance, 2 mm is coupled with the drill bit 1, wherein coupling is effected by means of a profiled annular intermediate piece 6 engaging, via step- or nose-like projections 7, in corresponding recesses provided in the regions both of the annular bit 3 and of the foremost portion of the external jacket tube 5. An entrained inner jacket tube 5' on its upper end region comprises a stop element 29 tightly abutting on the outer jacket tube 5. Entrainment of the outer jacket tube 5 in the drilling or advancing direction indicated by arrow 8 is effected via the coupling 6 by tensile action in the axial direction, while the drill bit 1 is rotatably mounted relative to the jacket tubes 5 and 5' in a manner that this rotating movement will not be impeded during drilling of the drill bit 1. It is, thus, apparent that the jacket tubes 5 and 5', which may be designed in an accordingly thin-walled manner, are entrained by the drill bit 1, the jacket tubes 5 and 5' surrounding the drill rod assembly schematically indicated by 9 while forming a free space 10.

It is, furthermore, apparent from FIG. 1 that the jacket tube 5 and the jacket tube 5' in their foremost portions comprise a plurality of peripherally distributed passage openings 11 mutually overlapping in the telescoped state, through which worked material can be introduced into the free space between the drill rod assembly 9 and the tubes 5 and 5' according to arrow 12 and subsequently can be conveyed outwards. The drill rod assembly 9 may be designed as a tube or provided with any other conduit via which a gaseous or liquid flushing agent can be supplied and pressed out into the free space 10 through the openings provided between the drill bit 1 and the passage openings 11.

The external contour of the drill hole to be produced is schematically indicated by 13 in FIGS. 1 and 2. It is immediately apparent that, when using accordingly thin-walled jacket tubes 5 and 5' which are merely exposed to tensile action in the axial direction of the drill hole caused by the drill bit 1 during the working procedure, the diameter of the drill hole 13 may altogether be dimensioned accordingly smaller. After completion of the drill hole 13, the pilot bit 2, which preferably has a cross section deviating from the circular form, is decoupled from the annular bit 3 and drawn off through the jacket tube 5' together with the drill rod assembly such that the entire inner space defined by the jacket tube 5' will be left, for instance, to the introduction of a roof bolt or a filling mass.

Figure 3:
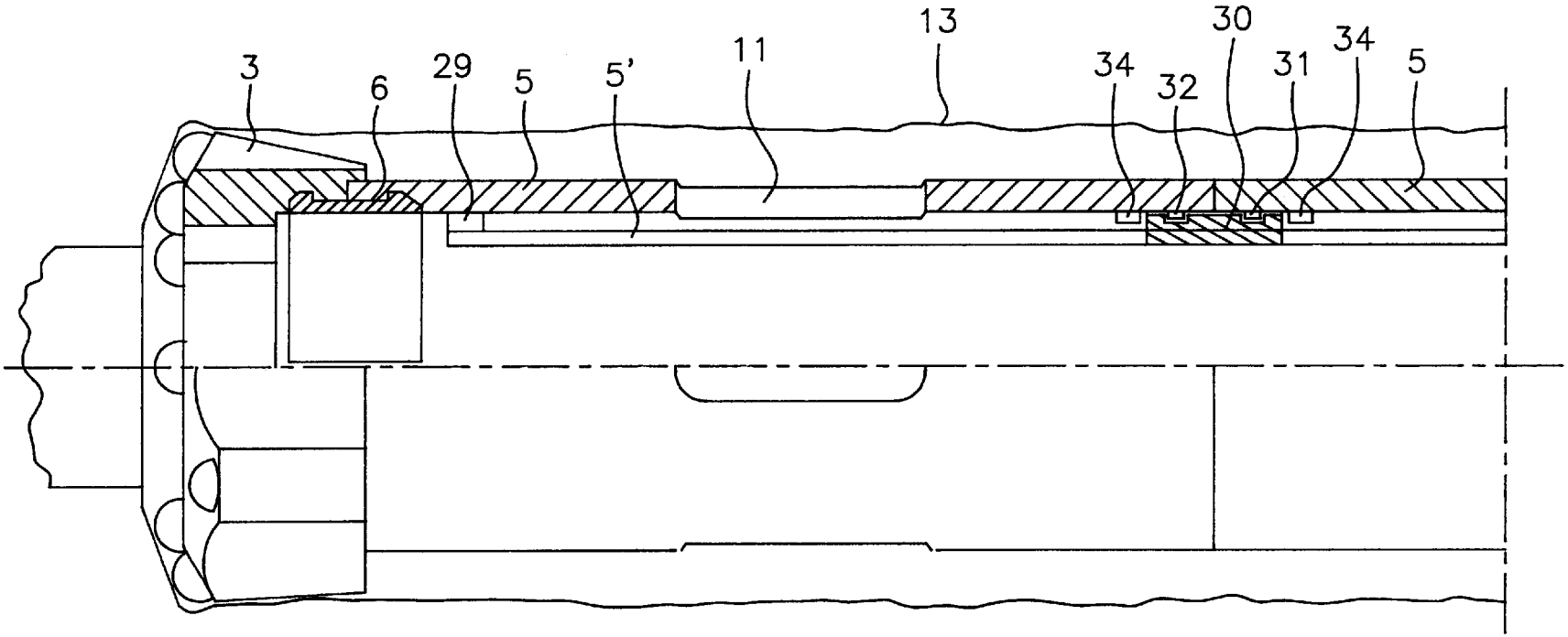
FIG. 3 is an again partially sectioned side view on an enlarged scale as compared to FIG. 1, over an enlarged longitudinal portion of the device of the invention according to FIG. 1 after removal of the central portion of the drill bit and the drill rod assembly.

The illustration according to FIG. 3 depicts a larger longitudinal portion, it being apparent that the pilot bit or central part 2 of the drill bit has already been removed together with the drill rod assembly so that only the jacket tubes or lining tubes 5 and 5' as well as the annular bit 3 have been left in the drill hole 13. From FIG. 3 it is, furthermore, apparent that a corresponding coupling element 14 is coupled to the drill bit in the foremost portion beside the coupling 6 between the drill bit or remaining annular bit 3 and the jacket tube 5. Via the passages 11 provided in the foreward portion, a filling mass may, for instance, be introduced into the front region of the drill hole 13 for an anchorage also into the free space between the delimitation of the drill hole 13 and the externally located jacket tube 5. Further longitudinal portions of the externally located jacket tubes 5 comprise projections 31 and 32 in their end portions, which projections are coupled with a sleeve 30 firmly connecting two portions of internally located jacket tubes 5'.

Figure 4:
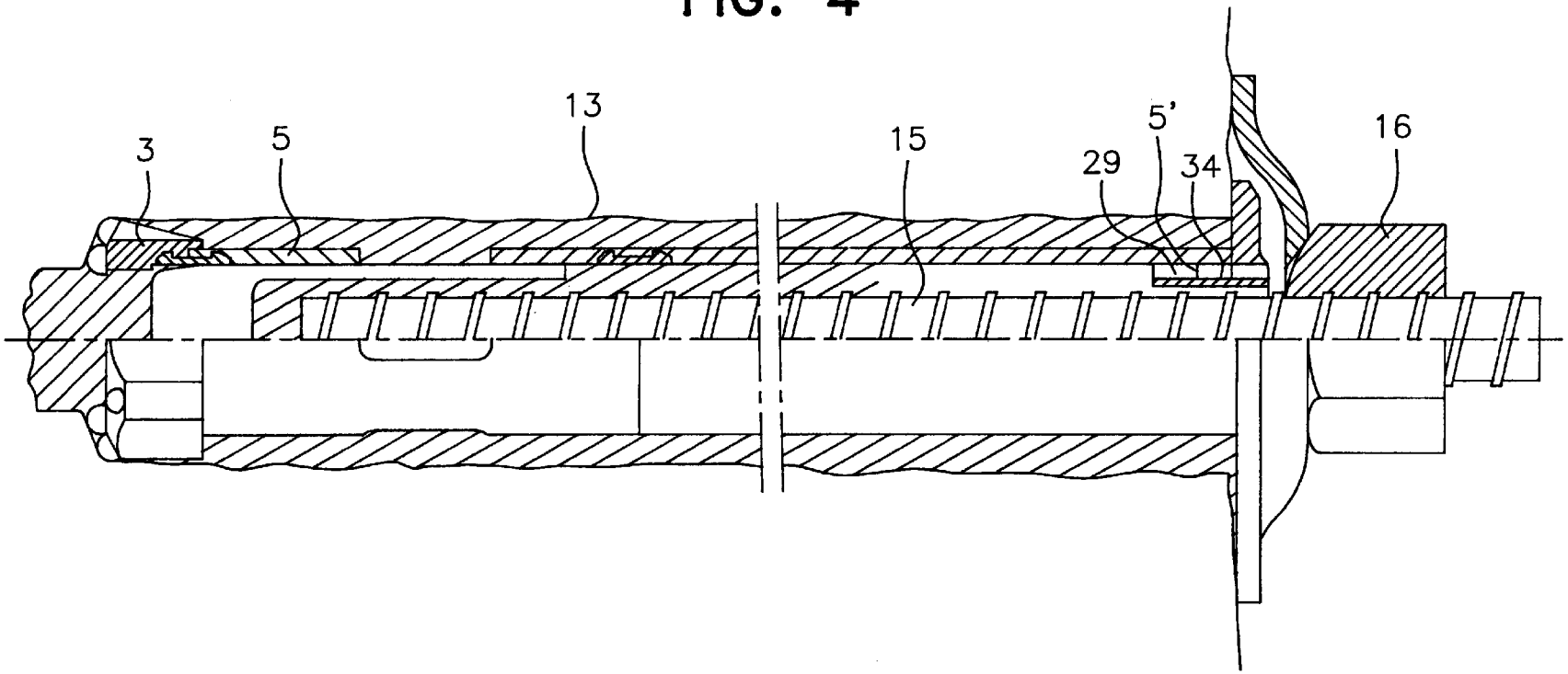
FIG. 4 is a partially sectioned view of a drill hole produced by the device according to the invention with a set roof bolt.

FIG. 4 illustrates a configuration in which a roof bolt schematically indicated by 15 is insertable, in particular by screwing, after the drill rod assembly has been removed into the jacket tubes 5 and 5' schematically illustrated in the completely extended state, said roof bolt 15 being additionally supported or braced on the soil by means of a screw assembly 16 in its bare zone. In that case, a suitable filling mass may have been additionally introduced into the jacket tubes 5 and 5' directly with the insertion of the roof bolt 15 in order to secure anchoring of the foremost portion with the annular bit 3 having remained in the soil.

Figure 6:
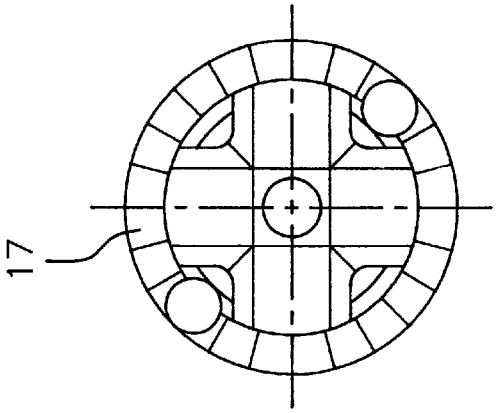
FIG. 6 is a view on the drill bit of that second embodiment in the direction of the arrow VI of FIG. 5.
Figure 5:
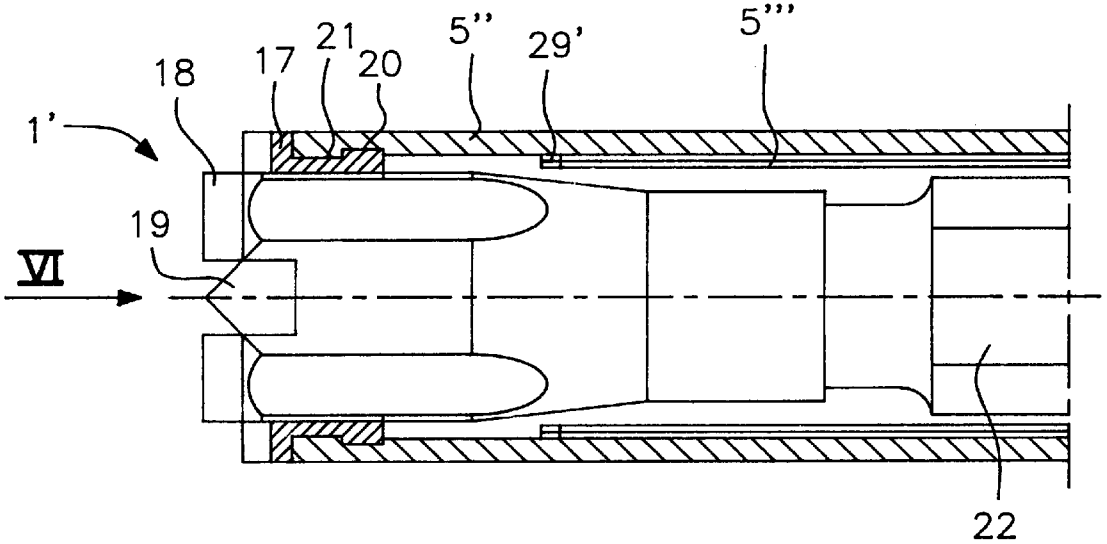
FIG. 5 shows a modified embodiment of a device according to the invention for carrying out the method of the invention in an illustration similar to FIG. 1.

In the representation according to FIGS. 5 and 6, a modified embodiment is shown in an illustration similar to FIGS. 1 and 2, wherein a jacket tube again denoted by 5" is rotatably fixed directly to the outer circumference of an annular bit 17 and a pilot bit equipped with cutting edges 18 is denoted by 19. Fixation to the outer circumference of the annular bit 17 in this embodiment is realized via appropriately offset or stepped partial regions both on the annular bit 17 and on the end of the jacket tube 5" facing the drill bit 1, the corresponding profiled sections being denoted by 20 and 21. The internally located jacket tube as well as its stop element are denoted by 5' and 29', respectively. The drill rod assembly coupled with the drill bit 1' is denoted by 22. Also in this embodiment, the central portion or pilot bit 19' of the drill bit 1 is pulled out together with the drill rod assembly 22 through the interior of the jacket tubes 5", 5' after completion of the drill hole, whereupon a roof bolt, for instance, may again be inserted and/or a filling may additionally be provided with a solidifying material and, in particular, grout.

Instead of inserting a roof bolt or anchor into a drill hole 13 lined with the jacket tubes 5 and 5', such a drill hole 13 may also serve, for instance, for drainage, wherein in that case a plurality of perforations or apertures are to be provided distributedly over the lengths of the jacket tubes 5 and 5' as well as peripherally.

Figure 7:
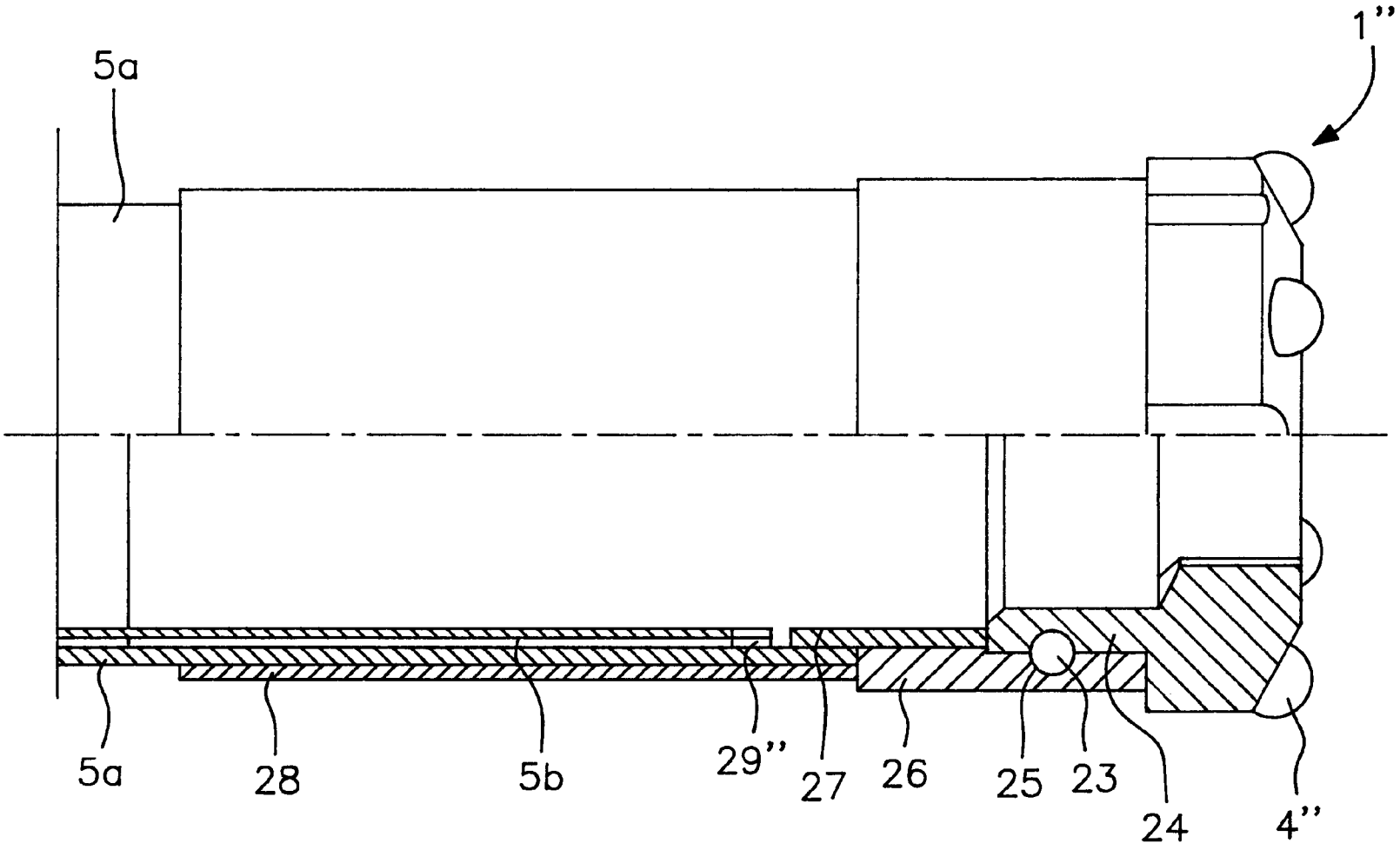
FIG. 7 in an illustration again similar to FIG. 1 depicts a modified embodiment of a device according to the invention for carrying out the method of the invention.

In the embodiment represented in FIG. 7, an optionally multi-part drill bit comprising hard material insets 4' is denoted by 1", jacket tubes entrained by the drill bit 1" being denoted by 5*a* and 5*b*. While the jacket tubes 5", 5' in the preceding embodiment may be made of, for instance, a metallic material, the jacket tubes 5*a* and 5*b* in the embodiment represented in FIG. 7 are produced of synthetic material like the stop element 29".

Fixation to the drill bit 1" is realized via a plurality of coupling elements in the form of balls 23, which are received in corresponding recesses 24 of semi-circular cross section provided on the rear side of the drill bit 1 and complementary semi-circular recesses 25 of a connection piece 26, the connection piece 26 being directly connected with the jacket tube 5*a* of synthetic material. The balls 23, which form the coupling elements between the drill bit 1 and the jacket tube 5, thus constitute a coupling in the manner of a ball bearing, thereby allowing for accordingly simple rotation between the jacket tube 5*a* and the drill bit 1" during a rotary or rotary percussive movement. Since a jacket tube 5*a* of synthetic material will exhibit an accordingly high flexibility, there are additionally provided in the region immediately following upon the drill bit 1" so as to overlap the jacket tube 5*a*, a supporting tube 27 on the inner side as well as a supporting tube 28 on the outer side, between which the jacket tube 5*a* of synthetic material is appropriately fastened or clamped immediately consecutive to the connection piece 26, wherein said additional supporting means 27 and 28 may be made, for instance, of metal.

With a view to adapting the material properties of the balls 23, which may be made of metal or synthetic material, to the bearing surfaces or bearing elements in the region of the recesses 24 and 25, the connection piece 26 as well as the extension of the drill bit 1" likewise may be made of metal or synthetic material or provided with appropriate coatings.

Figures 8A, 8B, 8C, 8D:
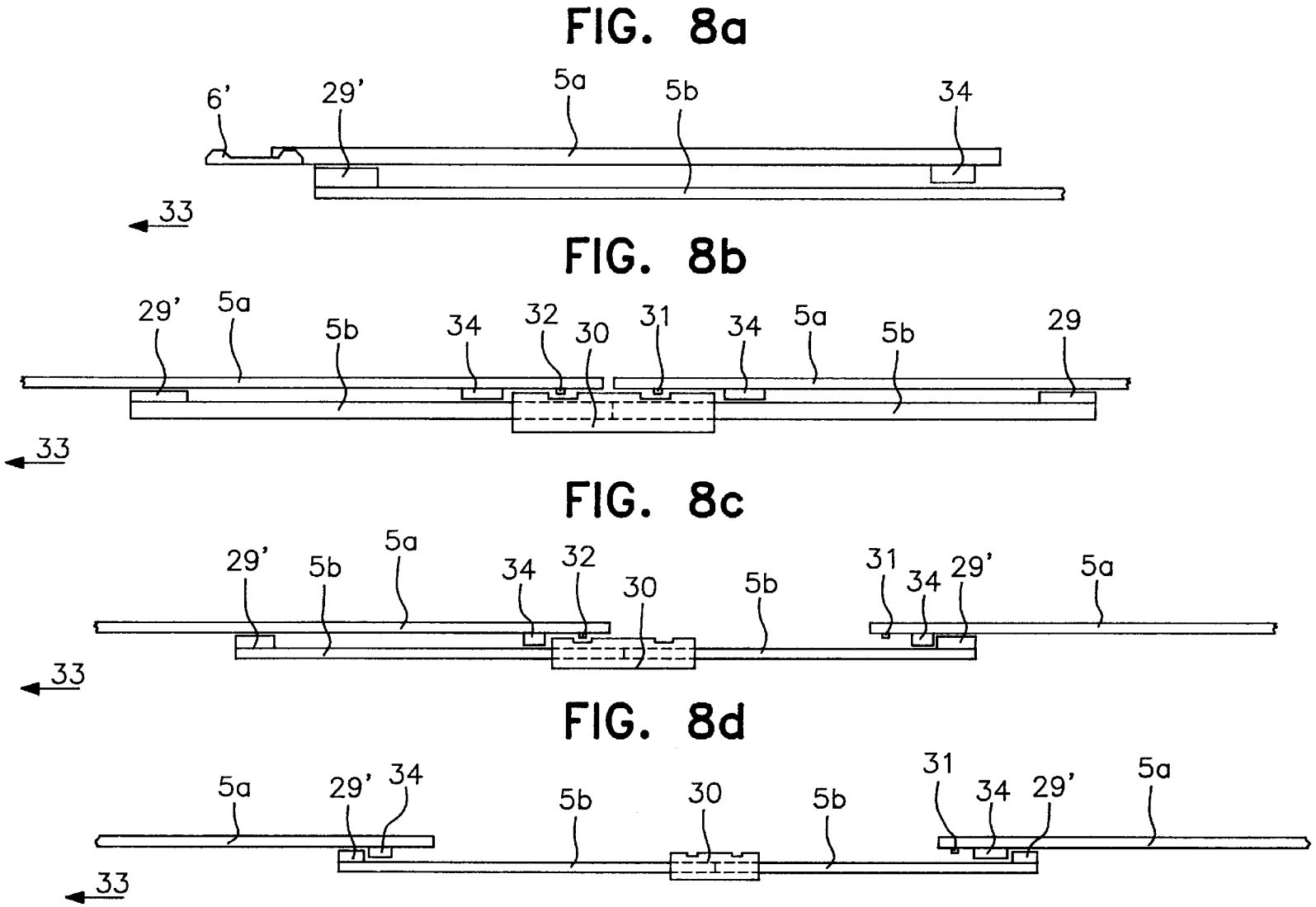
FIGS. 8*a*–8*d* are schematic illustrations of the internally and externally located jacket tubes, FIG. 8*a* illustrating the first jacket tube portions, viewed in the direction towards the drill bit, in the telescoped state, FIG. 8*b* representing the first and second internally and externally located jacket tube portions in the telescoped state, viewed from the drill bit, FIG. 8*c* depicting the same jacket tube portions as illustrated in FIG. 8*b* in the partially extended state, and FIG. 8*d* representing the jacket tube portions in the completely extended state.

FIGS. 8*a*–8*d* schematically illustrates the internally and externally located jacket tubes 5*a* and 5*b*, respectively, as they may be displaced relative to each other or slidingly pulled along each other during the advance of the drill bit into the rock or earth material. FIG. 8*a* depicts the first jacket tube portions 5*a* and 5*b* in the telescoped position, i.e. in the position at the beginning of drilling, viewed in the direction towards the drill bit 1". The externally located jacket tube section 5*a* schematically comprises an intermediate member 6' on its leading end, which intermediate member is intended to fix the outer jacket tube portion 5*a* to the drill bit 1" not illustrated in FIGS. 8*a*–8*d*, the advance direction of the drill bit 1 being indicated by arrows 33 in FIG. 8. On its end facing away from the drill bit, the outer jacket tube 5*a* comprises a projection 34, which is slidingly mounted on the inner jacket tube 5*b*. In an analogous manner, a projection 29' is provided on the end of the inner jacket tube 5*b* facing the drill bit 1", which projection may interact with the projection 34 of the outer jacket tube 5*a* in the extended state.

In FIG. 8*b*, the first two jacket tube portions of both the outer and inner jacket tubes 5*a* and 5*b* are schematically indicated, wherein the first jacket tube portion 5*a*, viewed in the direction towards the drill bit 1", again comprises a projection 34 on its end facing away from the drill bit 1", which projection interacts with the projection 29 of the inner jacket tube 5*b* in the extended state. The two outer jacket tubes 5*a* illustrated are not directly interconnected, but merely connected via a sleeve 30 firmly connecting the two internally located jacket tubes 5*b*. For this connection, projections 31, 32 are provided on the two outer jacket tube portions 5*a* on the end regions facing each other, which projections may engage in respective recesses of the sleeve element 30. In the telescoped state, both the outer jacket tube portions 5*a* and the inner jacket tube portions 5*b*, are, thus, firmly interconnected by the sleeve 30.

In order to have available as a lining for the drill hole also the length of the inner jacket tube portion during further advance into the rock or soil material, the projection 31 is brought out of engagement with the respective recess of the sleeve 30 by a rotary movement of the second jacket tube portion 5*a*, viewed from the direction of the drill bit 1", relative to the sleeve 30 of the inner jacket tube 5*b*, as illustrated in FIGS. 8*a*–8*d*, whereupon the outer jacket tube 5*a*, by further advance of the drill bit 1" in the direction of arrow 31, is slidingly guided on the inner jacket tube 5*b* until the stops 29 and 34 provided on the jacket tubes 5*a* and 5*b*, respectively, abut each other.

In order that also the length of the first jacket tube portion 5*b*, viewed from the direction of the drill bit 1", may be used for lining a drill hole, a tension opposite to the direction of the advance movement is subsequently induced on the end facing away from the drill bit 1 by holding fast the outer jacket tube 5*a*, thus causing the projection 32 of the first outer jacket tube portion 5*a* to be torn out of the respective recess of the sleeve 30 of the inner jacket tube 5*b* and the jacket tube portion 5 of the outer jacket tube, viewed in the direction towards the drill bit 1", to be slidingly entrained on the first jacket tube portion 5*b* in the direction towards the advance movement.

In the completely extended state, as represented in FIG. 8*d*, the lining of the drill hole is thus designed to be profiled, thereby being able to clearly reduce, in particular, the frictional forces acting on the jacket tubes.

What is claimed is:

1. A method for drilling and placing of roof bolts into holes in soil or rock material, said method comprising:

forming a drill hole by a drill bit mounted on a drill rod assembly and forming a lining by a jacket tube, removing, after completion of the drilling procedure, the drill bit from the jacket tube together with the drill rod assembly, and with the advance movement during drilling, at least one thin-walled jacket tube coupled at the end facing away from the work face with the drill bit, divided in a radial direction, is introduced into the drill hole in the axial direction by the drill bit only by tensile action and that after the removal of the drill rod assembly and the drill bit, at least one of a roof bolt is introduced into the jacket tube and a filling is realized with a solidifying material.

2. A method according to claim 1, wherein the drill bit is arranged so as to be rotatable relative to the jacket tube.

3. A method according to claim 1, wherein worked material is introduced into an interior of the jacket tube via at least one aperture provided in a region following upon the drill bit and is extracted from the drill hole in a free space provided between the jacket tube and the drill rod assembly.

4. A device for drilling in soil or rock material, said device comprising a drill bit mounted on a drill rod assembly for making a drill hole by at least one of a percussive and a rotary movement, the drill bit being designed to be divided in a radial direction and that, on an external periphery of the drill bit on an end facing away from a work face, at least one thin-walled jacket tube surrounding the drill rod assembly being positively connected with the drill bit via at least one coupling element only for tensile entrainment in a longitudinal direction of a drill hole.

5. A device according to claim 4, wherein the drill bit is rotatably connected with the jacket tube via the coupling element.

6. A device according to claim 4, wherein the coupling elements are formed by offset peripheral regions of the drill bit and of the jacket tube with matching complementary profiles.

7. A device according to claim 4, wherein the coupling elements are formed by a plurality of balls arranged in recesses provided on the drill bit and having substantially semi-circular cross sections and complementary recesses provided on a connection piece of the jacket tube following upon the drill bit.

8. A device according to claim 7, wherein the connection piece is made of one of metal, synthetic material and a coated material.

9. A device according to claim 4, wherein the coupling elements between the drill bit and the jacket tube are at least partially made of one of a damping material and a coated damping material.

10. A device according to claim 4, wherein an end region of the jacket tube facing the drill bit includes at least one passage opening having several bores or passage slits uniformly distributed over a circumference of the jacket tube.

11. A device according to claim 4, wherein a periphery of a length of the jacket tube includes perforations substantially uniformly distributed.

12. A device according to claim 4, wherein the drill bit at least is comprised of a central inner part and an outer part which are detachably coupled to each other for common advance movement, the central part of the drill bit having a slightly smaller external diameter relative to the internal diameter of an inner jacket tube.

13. A device according to claim 12, wherein, with a view to rotational entrainment, the central inner part of the drill bit has a cross section deviating from a circular form and is led out of the drill bit through an opening of the outer part of the drill bit.

14. A device according to claim 4, wherein an external diameter of the outer jacket tube substantially corresponds to external dimensions of the drill bit in the radial direction.

15. A device according to claim 4, wherein the jacket tube has a wall thickness of from 1 to 3 mm.

16. A device according to claim 4, wherein the jacket tube is made of one of metal and synthetic material.

17. A device according to claim 4, wherein, after the removal of the drill bit and of the drill rod assembly, a roof bolt capable of being braced having a portion projecting out of the soil is insertable and screwable into the jacket tube.

18. A device according to claim 4, wherein two jacket tubes are arranged substantially concentric with each other and held at a distance from each other by one of spacer elements and stop elements provided in an interspace between the jacket tubes.

19. A device according to claim 18, wherein at least an externally arranged jacket tube is comprised of several parts and, in a region of at least one junction of neighbouring jacket tube portions, are detachably coupled with an inner jacket tube via a fixation capable of being decoupled by relative rotation of neighbouring elements.

20. A device according to claim 18, wherein the concentrically arranged jacket tubes in at least one end region each comprise stop elements extending into the annular space provided between the jacket tubes and guiding and decoupling means for adjoining externally located jacket tube portions are arranged in a region of a connection element.

21. A device according to claim 18, wherein the concentrically arranged jacket tubes are connectable to an external region of the drill bit.

22. A device according to claim 18, wherein at least an externally located jacket tube is detachably fixed to the drill bit.

* * * * *